US005232752A

United States Patent [19]

Crespi et al.

[11] Patent Number: 5,232,752

[45] Date of Patent: Aug. 3, 1993

[54] DECORATIVE ORNAMENTS FOR GARMENTS

[76] Inventors: Mario Crespi; Danny Crespi, both of 10030 NW. 6th Ter., Miami, Fla. 33172

[21] Appl. No.: 803,436

[22] Filed: Dec. 6, 1991

[51] Int. Cl.[5] ..... A44C 17/02; B44C 1/18

[52] U.S. Cl. ..... 428/15; 63/26; 63/DIG. 3; 156/312; 428/67; 428/79

[58] Field of Search ..... 428/67, 79, 7, 14, 15; 156/312; 63/26, DIG. 3

[56] References Cited

U.S. PATENT DOCUMENTS

| | | | |
|---|---|---|---|
| 1,943,658 | 1/1934 | Dyckma | 428/51 |
| 2,569,398 | 9/1951 | Burd et al. | 428/78 |
| 2,596,965 | 5/1952 | Troy | 156/298 X |
| 3,025,820 | 3/1962 | Rosenthal | 428/64 X |
| 4,030,317 | 6/1977 | Rogell | 428/15 X |
| 4,295,347 | 10/1981 | Visconti | 63/DIG. 3 X |
| 4,323,611 | 4/1982 | Poll | 63/26 X |
| 4,415,623 | 11/1983 | Schlaepfer | 428/200 |
| 4,604,876 | 8/1986 | Hoffmann | 428/15 X |
| 4,935,268 | 6/1990 | Poll | 428/79 X |

*Primary Examiner*—Henry F. Epstein
*Attorney, Agent, or Firm*—Malloy & Malloy

[57] ABSTRACT

A decorative article for use on garments and the like to enhance the appearance thereof including a base with a flat central zone and an ornamental rim disposed about its periphery, and an ornamental center element sized and configured for receipt within the ornamental rim and including an exposed upper surface and a flat lower surface which is adhesively secured to the flat central zone of the base. Further, the base includes a bottom surface which may be adhesively secured to the garment, thereby providing an article which is easily assembled and implemented, and does not require special knowledge or tools.

12 Claims, 2 Drawing Sheets

DECORATIVE ORNAMENTS FOR GARMENTS

BACKGROUND OF THE INVENTION

1. Field of the Invention

This invention relates to a decorative article to be used to enhance the appearance of garments and the like, which is easily assembled and implemented by an individual, thereby providing the user with a quick, easy, economical, and attractive means of decorating garments and like articles.

2. Description of the Prior Art

Ornamental buttons, have for a long time, been widely used to decorate articles of apparel and other various items. The type of ornamental buttons commonly used, whose structure has remained the same for many years, includes a plastic base and a jeweled bead secured to one another. The known method of securing the bead and the base is that of passing a U-shaped protrusion on a flat underside of the bead through an aperture in the center of the base, followed by using specifically designed compression tools to deform the U-shaped protrusion such that it may not return through the aperture from where it passes. After assembly, the button is then sewn onto the garment in much the same manner as would an ordinary button. Unfortunately, the process necessitated by the known structure of ornamental button is time-consuming, requires special skills and/or tools. Further, the use of buttons necessitates that the protrusions by which the button is secured to the garment create a rough interior to the garment and do not allow the button to be completely flush against the material of the garment. For these reasons, there has been a longstanding need to develop a decorative article which is economical, easy to assemble and accordingly, may be implemented by any individual, provides all the aesthetic appeal of commonly used ornamental buttons, may be securely and smoothly secured to the surface of the garment, and does not require the added expense of cumbersome and expensive tools.

Applicant's invention is directed specifically to overcome the longstanding shortcomings of prior structures of ornamental buttons. It is structured to allow facilitated assembly in various combinations, eliminate the requirement for special tools or knowledge, be smoothly and securely attached to the garment without the need for sewing or stitching, and still be highly ornamentally attractive.

SUMMARY OF THE INVENTION

The present invention is directed towards a decorative article which may be secured to a garment individually or in a decorative array. The article includes primarily a base and ornamental element securely connected to one another. The base which includes a decorative rim about an exterior periphery thereof, further includes a flat central zone wherein a flat lower surface of the ornamental center element may be securely adhered, thereby maintaining the decorative upper surface of the ornamental center element in an exposed protruding position surrounded by the ornamental rim. The bottom surface of the base is also flat and smooth such that an adhesive element may be used to securely adhere the decorative article to the surface of a garment.

It is a purpose of this invention to provide an easily assembled, cost effective decorative article which may be utilized by an individual without the need for special tools or knowledge.

It is further an object of the present invention to provide a decorative article which will quickly and smoothly adhere to a garment without the need for sewing or stitching.

It is yet another object of the present invention to overcome the longstanding shortcomings of commonly utilized ornamental buttons.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
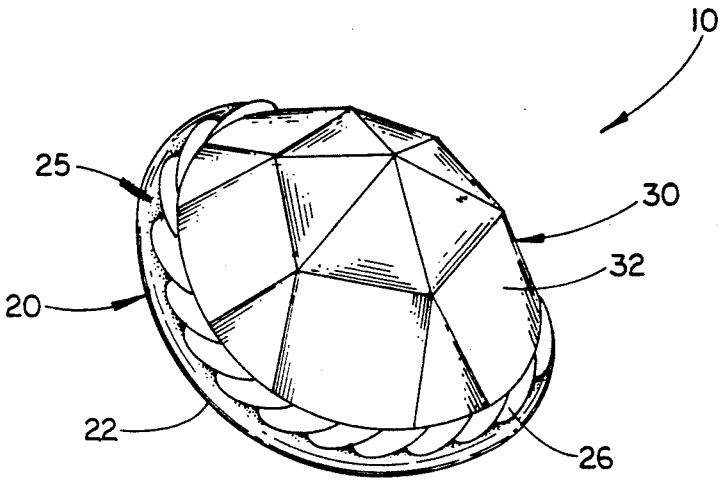
FIG. 1 is a perspective element of the decorative article.

As detailed throughout FIGS. 1–5, the present invention is directed towards a decorative article 10 for use on a garment 50 to enhance the appearance thereof. As shown in FIG. 1, the decorative article 10 includes a base 20 and an ornamental center element 30 concentrically positioned therein. The base 20 includes an ornamental rim 26 about the outer periphery of the top surface 25 thereof. The ornamental rim 26, which may be in a variety of sizes and designs, is structured and disposed to securely surround the ornamental center element 30 such that a decorative upper surface 32 thereof protrudes from the rim 26.

Figure 2:
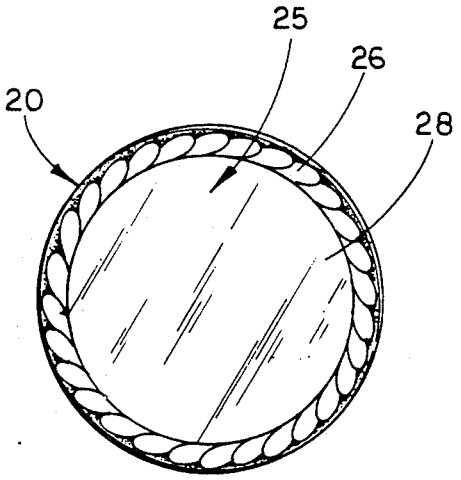
FIG. 2 is a top view of the base portion of the decorative article.

Further included in the base 20, and as best detailed in FIG. 2, is a flat central zone 28. The flat central zone 28 is substantially the same diameter as a flat lower surface 34 of the ornamental center element 30, such that the ornamental center element 30 may be positioned in a flush, overlying relation atop the flat central zone 28.

The ornamental center element 30 may be formed of a plastic material and resemble a gemstone, pearl or rhinstone. The ornamental center element 30 may also be formed of leather, wood or textile material.

Figure 3:
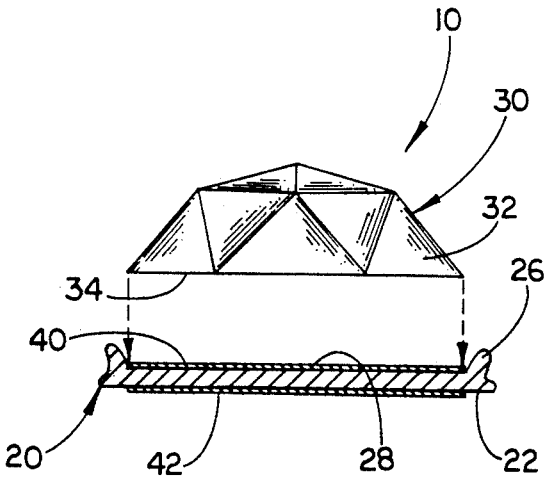
FIG. 3 is a cross-sectional view of the decorative article.

In order to secure the ornamental center element 30 to the base 20, an adhesive layer 40, detailed in FIG. 3, is provided over the flat central zone 28 such that the flat lower surface 4 of the ornamental center element 30 will be securely attached thereto.

Finally, a second adhesive layer 42 is disposed along a bottom surface 22 of the base 20, such that the decorative article 10 will be securely, evenly, and easily fastened to a garment 50. In a preferred embodiment, a styrene based adhesive such as E-6000 from Eclectic Products, Inc. is used to securely adhere the base 20 to the garment 50.

Figure 4:
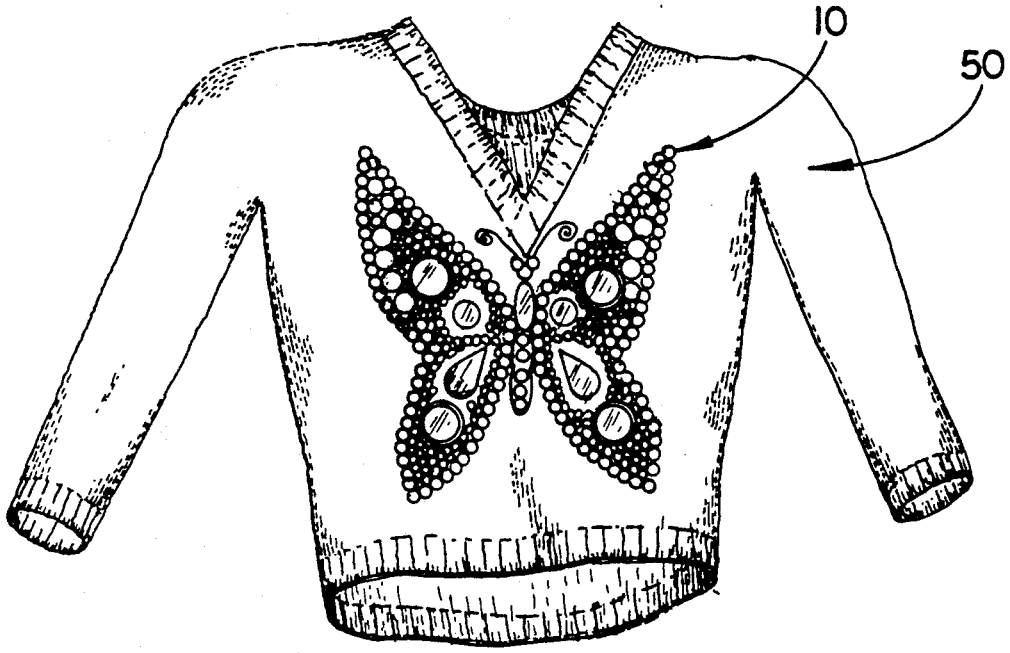
FIG. 4 is a perspective view of an ornamental array of the decorative articles adhered to a garment.
Figure 5:
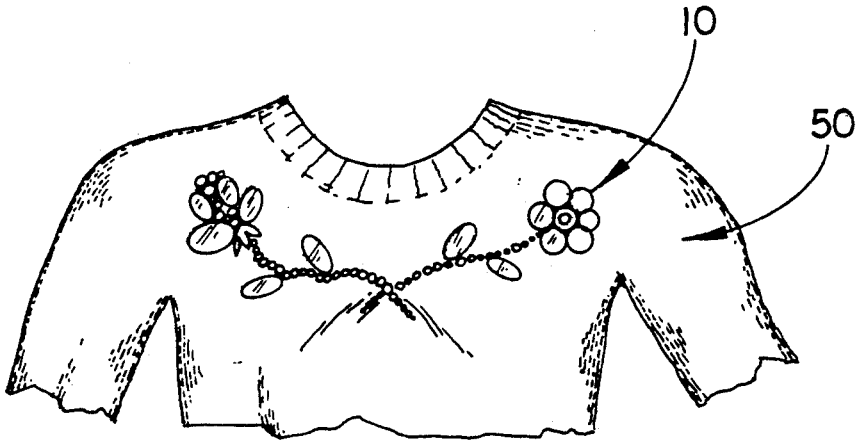
FIG. 5 is a second perspective view of an ornamental array of the decorative article.

As detailed in FIGS. 4 and 5, the decorative article 10 may be positioned with a plurality of differently ornamented decorative articles 10 to form an ornamental design on a garment 50.

Now that the invention has been described:

1. A decorative article for use on a garment to enhance the appearance thereof, said article comprising:

a base having a top surface and a bottom surface, said top surface including an ornamental rim disposed about a periphery thereof in surrounding relation to a substantially flat central zone, an ornamental center element sized and configured for receipt within said ornamental rim and including an upper exposed surface and a substantially flat lower surface, said lower surface being structured and disposed for mating engagement with said central zone of said base for attachment thereto, and adhesive means for attaching said center element to said central zone of said base and further for adhering said bottom surface of said base to an exposed surface of the garment.

2. An article as in claim 1 wherein said ornamental rim is disposed above a substantially, planar level surface of said central zone so as to define a surrounding border.

3. An article as in claim 2 wherein said ornamental rim includes decorative means thereon.

4. An article as in claim 3 wherein said center piece is formed of a plastic material.

5. An article as in claim 4 wherein said center piece resembles a gemstone.

6. An article as in claim 4 wherein said center piece resembles a pearl.

7. An article as in claim 4 wherein said center piece resembles a rhinestone.

8. An article as in claim 3 wherein said center piece is formed of leather.

9. An article as in claim 3 wherein said center piece is formed of wood.

10. An article as in claim 3 wherein said center piece is formed of a textile material.

11. An article as in claim 1 wherein said adhesive means includes a styrene base.

12. A method of attaching decorative articles to a garment comprising the steps of:

applying an adhesive substance to a central zone of a base piece, placing an ornamental center element in the central zone such that a lower flat surface of said center element adheres to said central zone of said base piece with an ornamental rim of said base piece disposed in substantially surrounding relation to said center element, applying the adhesive substance to a bottom surface of the base piece, placing said base piece and attached center element on the garment so that said bottom surface is disposed in mating engagement with an exposed surface of the garment, and maintaining said base piece and attached center element in place on the garment until the adhesive substance cures.

* * * * *